United States Patent [19]

Johnson et al.

[11] Patent Number: 5,018,616

[45] Date of Patent: May 28, 1991

[54] BALANCED SELF ADJUSTABLE ESCALATOR HANDRAIL DRIVE

[75] Inventors: Gerald E. Johnson, Farmington; James A. Rivera, Bristol, both of Conn.

[73] Assignee: Otis Elevator Company, Farmington, Conn.

[21] Appl. No.: 609,285

[22] Filed: Nov. 5, 1990

[51] Int. Cl.[5] ..... B66B 23/04

[52] U.S. Cl. ..... 198/335

[58] Field of Search ..... 198/330, 331, 335, 835

[56] References Cited

U.S. PATENT DOCUMENTS

| | | | |
|---|---|---|---|
| 3,653,484 | 4/1972 | Taylor | 198/335 |
| 3,666,075 | 5/1972 | Iwata | 198/335 |
| 4,134,883 | 1/1979 | Mendelsohn et al. | 198/335 X |
| 4,200,177 | 4/1980 | Sato et al. | 198/335 |
| 4,589,539 | 5/1986 | Boltrek et al. | 198/331 |
| 4,674,619 | 6/1987 | Nakazawa et al. | 198/331 |
| 4,875,568 | 10/1989 | Hermann et al. | 198/335 |
| 4,895,240 | 1/1990 | Bruehl et al. | 198/335 X |
| 4,901,839 | 2/1990 | Johnson et al. | 198/335 |

FOREIGN PATENT DOCUMENTS

| | | | |
|---|---|---|---|
| 0031479 | 3/1977 | Japan | 198/335 |
| 0022686 | 2/1979 | Japan | 198/335 |
| 1123981 | 11/1984 | U.S.S.R. | 198/335 |
| 1481182 | 5/1989 | U.S.S.R. | 198/335 |

*Primary Examiner*—D. Glenn Dayoan

*Attorney, Agent, or Firm*—William W. Jones

[57] ABSTRACT

The handrail drive utilizes one or more pairs of drive rollers which form a nip through which the handrail moves. The drive rollers are mounted on rotating drive shafts which in turn are eccentrically mounted in rotatable bearings. The drive rollers will automatically tighten on the handrail as friction increases between the rollers and handrail due to increased resistance to movement of the handrail. The rotatable bearings are connected together to ensure that each roller tightens equally on each side of the handrail so that the handrail is not bent through an S curve as it passes through the drive roller nip.

4 Claims, 2 Drawing Sheets

BALANCED SELF ADJUSTABLE ESCALATOR HANDRAIL DRIVE

DESCRIPTION

1. Technical Field

This invention relates to an automatically self-tightening handrail drive assembly which ensures a balanced tightening of the handrail drive rollers on the opposite sides of the handrail.

2. Background Art

U.S. Pat. No. 4,901,839 granted Feb. 20, 1990 to Gerald E. Johnson and James A. Rivera discloses an escalator, or the like conveyor, moving handrail drive which automatically increases its driving power in response to increased resistance to movement of the handrail. The handrail drive includes a pair of cooperating drive rollers which are mounted in eccentric fashion in a pair of opposed rotatable bearings. The drive rollers form a nip through which the handrail passes. As resistance to movement of the handrail increases, as when the escalator or walkway is fully loaded, frictional forces between the handrail and drive rollers increase. Increased frictional forces between the rollers and handrail causes the eccentric bearings to rotate, which moves the drive rollers closer together thus increasing nip pressure on the handrail.

In most cases, an escalator or moving walkway handrail is a composite structure. Since the handrail slides over a guide rail, the undersurface of the handrail is made from an appropriately durable material which has a low coefficient of friction. Typically, a woven fabric material will form the guide rail-contacting surface of the handrail. The outer exposed surface of the handrail, on the other hand, is formed from a durable material, typically rubber, which has a high coefficient of friction so that a passenger's hand will not accidentally slip on it. The difference in the coefficients of friction between the outer or exposed surface of the handrail, and its inner guide rail-contacting surface can result in a differential tightening of the above-described handrail drive rollers. This condition will be intensified at higher handrail resistance levels. The reason for the resultant differential nip is that one drive wheel will encounter the high friction rubber surface and will pivot through a proportionally higher locking angle, while the other drive roller will engage the low friction inner surface of the handrail, and will pivot through a smaller locking angle. The different degrees of pivoting of the rotating bearings results in offset lines of engagement between the two drive rollers, which in turn imposes an S curve path of travel on the handrail. The resultant deformation of the handrail shortens its useful life. It would be desirable to limit or eliminate the unequal tightening of the drive rollers on the handrail so that the S curve deformation of the handrail would be prevented.

DISCLOSURE OF THE INVENTION

This invention is directed toward a handrail drive of the type described above, which provides for a balanced and substantially equal tightening of the two drive rollers onto the handrail. In order to achieve the balanced roller tightening, the two rotatable bearings are physically connected together in such a manner that the bearing which is under the greatest rotational moment will impose on the other bearing a like rotational moment. The connection can take the form of a transfer link connected to the rotatable bearings; or a gear train connecting the rotatable bearings; or a like rotational motion transferring connection. With the aforesaid connection between the rotating bearings, the bearing subjected to the greatest rotational load will control the degree of roller tightening by transferring that load to the other bearing. In this manner, the bearings will both always pivot through the same or substantially the same included angle.

It is therefore an object of this invention to provide an escalator handrail drive assembly which includes a pair of rollers providing a nip through which the handrail is moved.

It is a further object of this invention to provide a handrail drive assembly of the character described wherein the rollers will automatically tighten the nip in response to increases in resistance to movement of the handrail.

It is another object of this invention to provide a handrail drive assembly of the character described wherein the degree of nip tightening is balanced between the two drive rollers.

These and other objects and advantages of the invention will become more readily apparent from the following detailed description of two preferred embodiments thereof when taken in conjunction with the accompanying drawings, in which:

BEST MODE FOR CARRYING OUT THE INVENTION

Figure 1:
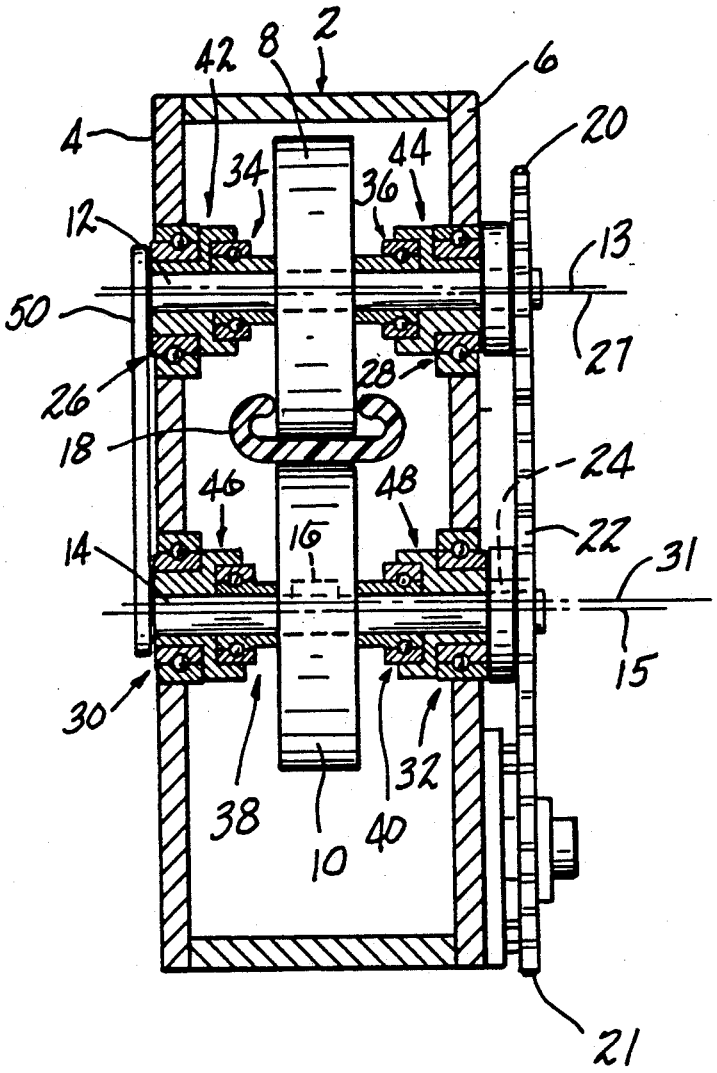
FIG. 1 is a sectional view of the drive assembly of this invention showing the eccentricity of the roller and sprocket shafts, and the shaft mount bearings.

Referring now to FIG. 1, the housing for the drive mechanism is denoted by the numeral 2, and includes opposed side walls 4 and 6. Driving rollers 8 and 10 are mounted on shafts 12 and 14, respectively, and are keyed to the shafts by keys 16 (only one of which is shown). The rollers 8 and 10 combine to form a nip through which the handrail 18 passes. Chain sprockets 20 and 22 are secured by keys 24 (only one of which is shown) to the shafts 12 and 14, respectively. The rollers 8, 10, respective shafts 12 and 14, and respective sprockets 20 and 22 thus rotate in concert. Bearings 26 and 28 are mounted in the housing walls 4 and 6, as are bearings 30 and 32. Shaft bearings 34, 36, 38 and 40 are mounted on the shafts 12 and 14, respectively. Bushing 42 interconnects bearings 26 and 34, and similarly bushings 44, 46 and 48 interconnect bearings 28 and 36; 30 and 38; and 32 and 40, respectively. As a result, the shafts 12 and 14 rotate in the bushings 42, 44, 46 and 48, respectively. Additionally, bushings 42, 44, 46 and 48 can rotate within the housing walls 4 and 6 by virtue of the bearings 26, 28, 30 and 32, respectively.

In FIG. 1, the mechanism is shown as it appears at rest, i.e., when the sprockets 20 and 22 are not moving and when the handrail 18 is not moving. The axis of the shaft 12 designated by the numeral 13, and the axis of the shaft 14 is designated by the numeral 15. The axes of the bearings 26, 28 and the bushings 42, 44 are designated by the numeral 27 while the axes of the bearings 30, 32 and the bushings 46, 48 are designated by the numeral 31. It will be noted that the axes 13 and 27 are offset, as are the axes 15 and 31, and that the axes 27 and 31 are closer together, and closer to the handrail 18 and nip than are the axes 13 and 15. The device is designed to provide only a very light compression of the handrail 18 by the rollers 8 and 10 when at rest as is shown in FIG. 1. It will be appreciated that the axes 13 and 15 are as far apart as they can be as shown in FIG. 1. A link 50 connects the bearings 26 and 30, as is most clearly shown in FIG. 2.

Figure 2:
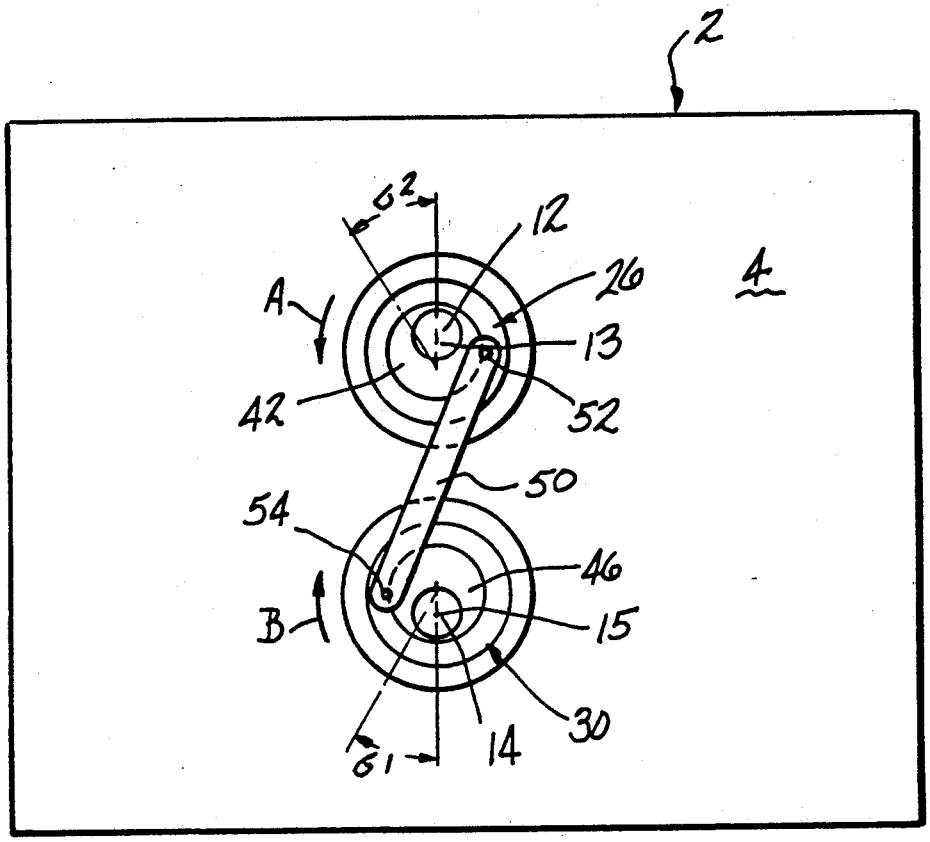
FIG. 2 is an elevational view of the drive assembly taken from the left side of FIG. 1 showing the equalizer connection between the two rotatable bearings.

Referring to FIG. 2, it will be noted that the link 50 is connected to the bearings 26 and 30 by means of pivot pins 52 and 54, respectively, which are located at the 3 o'clock and 9 o'clock positions on the inner races of the bearings 26 and 30, respectively. Presuming that the assembly 2 drives the handrail 18 from left to right as viewed in FIG. 2, when the rollers 8 and 10 tighten onto the handrail 8, the inner races of the bearings 26 and 30 will rotate in the direction of the arrows A and B, respectively. This will cause the axes 13 and 15 of the drive shafts 12 and 14, respectively, to swing about the bearing axes 27 and 31 through included angles of $\sigma^1$ and $\sigma^2$, Without the link connection, under high loads, $\sigma^1$ can be nearly twice $\sigma^2$ because the roller 10 contacts the high coefficient of friction outer surface of the handrail 18, while the roller 8 contacts the lower coefficient of friction inner handrail surface, as shown in FIG. 1. The link 50, however, ensures that the angles $\sigma^1$ and $\sigma^2$ will be substantially equal. This ensures that the respective lines of contact between the rollers 8 and 10 and the opposite sides of the handrail 18 will be contained in a common vertical plane, and will not result in an S curve being imposed upon the handrail 18.

Figure 3:
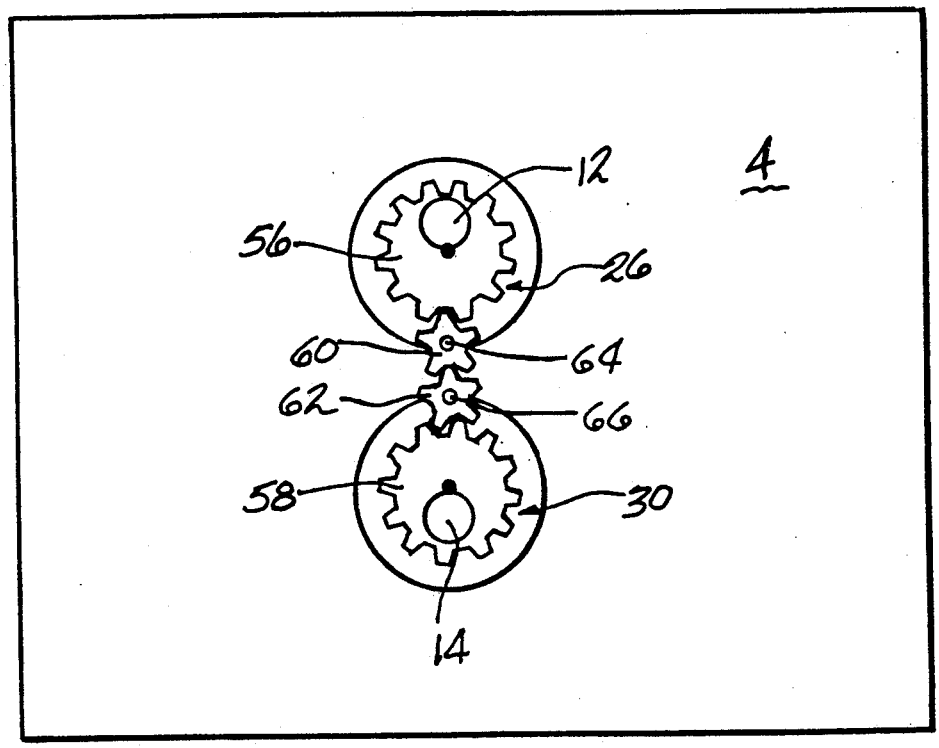
FIG. 3 is a view similar to FIG. 2 but showing an alternative connection between the rotatable bearings.

Referring to FIG. 3, there is shown an alternative embodiment of a rotation balancing connection between the two bearings 26 and 30. In the embodiment of FIG. 3, the bearing 26 has a gear 56 affixed to its inner race, and the bearing 30 has a gear 58 affixed to its inner race. The gears 56 and 58 will thus rotate with the inner races of the bearings 26 and 30. Gears 60 and 62 connect the bearing gears 56 and 58 so that rotation of the gear 58 in a clockwise direction will influence rotation of the gear 56 in a counterclockwise direction. The connecting gears 60 and 62 are journaled on shafts 64 and 66, respectively, mounted in the sidewall 4, which shafts 64 and 66 do not move angularly. The gear trains 56, 60, 62 and 58 thus ensure that the drive shafts 12 and 14 swing through substantially equal angles when the rollers 8 and 10 are tightened onto the handrail 18.

It will be readily appreciated that the handrail drive assembly of this invention will result in longer handrail operating life while continuing to operate under relatively high drive loads. The balancing of roller pressure between the drive roller pair creates an even division of pressure load components on the handrail and prevents the handrail from being subjected to an S curve path of travel through the roller nip.

Since many changes and variations of the disclosed embodiments of the invention may be made without departing from the inventive concept, it is not intended to limit the invention otherwise than as required by the appended claims.

What is claimed is:

1. A handrail drive assembly for a moving handrail, said assembly comprising:

a) a pair of drive rollers mounted on rotatable drive roller shafts, said drive rollers forming a nip through which the handrail passes;

b) rotatable end bearings supporting opposite ends of said drive roller shafts, said end bearings being mounted eccentrically of said drive roller shafts;

c) drive means for rotating said drive rollers and drive roller shafts on said end bearings whereby the axes of said drive rollers move toward each other due to the eccentricity of said shafts and bearings, to increase nip pressure on the handrail responsive to resistance to movement of the handrail; and d) means interconnecting the end bearings at one end of said drive roller shafts, said means being operable to ensure that said drive roller axes move through substantially equal included angles when increasing the nip pressure.

2. The handrail drive assembly of claim 1 wherein said means interconnecting is a link having opposite ends pivotally connected to each of said end bearings.

3. The handrail drive assembly of claim 2 wherein said link interconnects a 9 o'clock position on one end bearing with a 3 o'clock position on the other end bearing.

4. The handrail drive assembly of claim 1 wherein said means interconnecting comprises meshing gear means mounted on and rotatable with said end bearings, said gear means being operable to transfer rotational movement of one of said end bearings to the other of said bearings.

* * * * *